US011702723B2

(12) United States Patent
Pethe

(10) Patent No.: US 11,702,723 B2
(45) Date of Patent: Jul. 18, 2023

(54) SILVER ALLOY WITH IMPROVED MECHANICAL PROPERTIES

(71) Applicant: Subodh Suhas Pethe, Thane (IN)

(72) Inventor: Subodh Suhas Pethe, Thane (IN)

(73) Assignee: Subodh Subas Pethe, Thane (IN)

( * ) Notice: Subject to any disclaimer, the term of this patent is extended or adjusted under 35 U.S.C. 154(b) by 79 days.

(21) Appl. No.: 17/425,622

(22) PCT Filed: Jan. 21, 2020

(86) PCT No.: PCT/IN2020/050064
§ 371 (c)(1),
(2) Date: Jul. 23, 2021

(87) PCT Pub. No.: WO2020/152703
PCT Pub. Date: Jul. 30, 2020

(65) Prior Publication Data

US 2022/0098703 A1 Mar. 31, 2022

(30) Foreign Application Priority Data

Jan. 24, 2019 (IN) ..... 201921003025

(51) Int. Cl.
*C22C 5/08* (2006.01)

(52) U.S. Cl.
CPC ..... *C22C 5/08* (2013.01)

(58) Field of Classification Search
None
See application file for complete search history.

(56) References Cited

U.S. PATENT DOCUMENTS

| | | | | |
|---|---|---|---|---|
| 3,929,474 | A | 12/1975 | Ingersoll | |
| 5,037,708 | A | 8/1991 | Davitz | |
| 5,039,479 | A | 8/1991 | Bernhard et al. | |
| 5,817,195 | A | 10/1998 | Davitz | |
| 6,139,652 | A | 10/2000 | Carrano et al. | |
| 9,267,191 | B2 | 2/2016 | Raykhtsaum | |
| 2008/0128054 | A1 | 6/2008 | Johns | |
| 2008/0166260 | A1* | 7/2008 | Faverjon | C22C 1/03 420/505 |
| 2020/0060457 | A1 | 2/2020 | Zezula | |

FOREIGN PATENT DOCUMENTS

| | | | |
|---|---|---|---|
| CN | 1248044 | A | 3/2002 |
| CN | 102699567 | A | 10/2012 |
| CN | 105220003 | A | 1/2016 |
| DE | 19821386 | A1 | 9/1999 |
| EP | 3329024 | B1 | 5/2021 |
| WO | 03028669 | A1 | 4/2003 |
| WO | 2004066354 | A2 | 8/2004 |
| WO | 2012125516 | A3 | 9/2012 |
| WO | 2017021818 | A2 | 2/2017 |

* cited by examiner

*Primary Examiner* — Brian D Walck
(74) *Attorney, Agent, or Firm* — Kramer & Amado, P.C.

(57) ABSTRACT

The present invention discloses silver alloy composition consisting of at least 90.0% silver, 0.01-1.5% by weight of each of zirconium, magnesium, titanium and the balance copper with improved mechanical properties. The alloying metal in silver alloy impart both high "as cast" and "60% cold worked" hardness with workable springiness, reduced specific gravity and is resistant to wear and tear.

9 Claims, No Drawings

SILVER ALLOY WITH IMPROVED MECHANICAL PROPERTIES

FIELD OF INVENTION

The present invention relates to silver alloy composition consisting of at least 90.0% silver, 0.01-1.5% by weight of each of zirconium, magnesium and titanium and the balance copper with improved mechanical properties. The alloying metal in silver alloy impart both high "as cast" and "60% cold worked" hardness with workable springiness, reduced specific gravity and is resistant to wear and tear.

BACKGROUND AND PRIOR ART

Silver metal like gold is considered a precious metal and is extremely soft, ductile and malleable. Silver has a brilliant white metallic lustre and can take a high polish, exhibits high electrical conductivity, thermal conductivity, reflectivity and good corrosion resistance. These intrinsic qualities of silver make it a good material choice for a wide range of industrial applications. Silver besides coinage is used in the production of jewellery, high value tableware and utensils. Silver also finds application in medical instruments, in dentistry, in opticals, electrical and electronic devices, in photographic compounds, as conductive surfaces in voltaic cells as well as other formed, extruded and molded pieces find use in industry for varied applications.

Silver categorized as "fine silver" contains at least 99.5% pure silver, however, products made out of fine silver are easily dented or bent out of shape and are susceptible to damage. Hence, silver is rarely used in pure form.

Fine silver being very soft and ductile, its use alone is not feasible due to its inherent lack of hardness. Fine silver metal has a Vickers hardness of about 251HV. To obtain a reinforcement of the structure and consequent increase in hardness, silver is traditionally alloyed with copper. Copper is normally used in the production of sterling silver, which must contain a minimum of 92.5% silver. Sterling silver alloy is a material of choice when appearance is supreme and strength and durability is important such as in jewellery, coinage and silverware.

Sterling silver alloy are commercially available and are described in literature. Some of these alloy claim features such as high "as cast" hardness and the ability to be hardened by heat treatment (reversible hardenability). The exemplary patents viz. U.S. Pat. Nos. 5,817,195, 5,039,479, 5,037,708, 6,139,652, US 2006045792, U.S. Pat. No. 9,267,191 describe alloy of pure silver or sterling silver alloy, with one or more base elements such as Zn, fn, Sn, Ga, small quantities of silica, noble metals and such like.

EP3329024 provides an age-hardenable sterling silver alloy which comprises silver (Ag): from 92.5 to 96.8% by weight; palladium (Pd): from 0.7 to 1.9% by weight; sum of zinc (Zn) and indium (In): from 2.5 to 6.8% by weight, optionally germanium (Ge) and/or silicon (Si): maximum 0.25% by weight, copper (Cu): maximum 3% by weight, tin (Sn) and/or gallium (Ga): maximum 2% by weight. The alloy of the composition have a hardness after hardening of about 100-120 HV (comparable with that of a standard sterling silver alloy) and an "as cast" or homogenized hardness of not less than 50-60 HV (comparable with that of a standard sterling silver alloy).

WO2012125516 describes titanium containing sterling silver alloy comprising from about 92.5 wt % to about 99.5 wt % silver and from about 0.5 wt % to about 7.0 wt % titanium and a third metal optionally selected from the group consisting of palladium, niobium, aluminum, germanium, boron, zinc, copper and zirconium with improved hardness.

WO2017021818 discloses an age-hardenable sterling silver alloy comprising silver—92.5 to 96.8% by weight; palladium—0.7 to 1.9% by weight; sum of zinc (Zn) and indium (In)—2.5 to 6.8% by weight; optionally germanium (Ge) and/or silicon (Si): maximum 0.25% by weight; copper (Cu): maximum 3% by weight; tin (Sn) and/or gallium (Ga): maximum 2% by weight and may further include aluminium (Al), magnesium (Mg), manganese (Mn), titanium (Ti), up to a maximum value of 0.2% by weight in the formation of a protective layer of oxides and other elements that serve as grain refiners, de oxidants. The sterling silver alloy of WO'818 has Vickers hardness ranging from about 18 to about 120 HV.

Further, silver alloy with gold, palladium, zinc, germanium, platinum, and other metals of the periodic table as alloying metals are described in the art to obtain or enhance the properties of silver alloy for its specific applications. The exemplary patents/patent applications/patent publications include but is not limited to U.S. Pat. No. 3,929,474, WO2004066354, WO03028669, CN1248044 (A), CN102699567 or DE19821386.

The mechanical properties such as hardness of silver alloy is improved in the art through age hardening which requires heating a mixture to a high temperature, then cooling, then heating to a medium temperature, and then cooling again.

In light of the above, the present inventors felt that there is a scope to provide silver alloy composition which can be further hardened, with workable springiness and resistance to wear and tear.

The present invention is based on the object of developing silver alloy having at least 90% by weight of silver with improved hardness both "as cast" and "cold worked (60%) hardening", improved workable springiness and is resistant to wear and tear.

SUMMARY OF THE INVENTION

To meet the above objectives, the present invention provides an alloy composition with improved mechanical properties comprising;

i. 0.01 to 1.5% by weight of zirconium;
ii. 0.01 to 1.5% by weight of magnesium;
iii. 0.01 to 1.5% by weight of titanium;

for at least 900% by weight of silver and wherein the balance of said alloy includes copper.

Accordingly, the silver alloy composition with improved mechanical properties comprises;

i. 90.0% to 99.5% by weight of silver;
ii. 0.01 to 1.5% by weight of zirconium;
iii. 0.01 to 1.5% by weight of magnesium;
iv. 0.01 to 1.5% by weight of titanium; and
v. 0.1 to 9.97% by weight of copper.

In another preferred aspect, the present invention discloses sterling silver alloy composition with improved mechanical properties comprising;

i. 92.5% by weight of silver;
ii. 0.15% by weight of zirconium;
iii. 0.15% by weight of magnesium;
iv. 0.15% by weight of titanium; and
v. 7.05% by weight of copper.

In yet another preferred aspect, the present invention discloses silver alloy composition with improved mechanical properties comprising;

i. 97% by weight of silver;
ii. 0.15% by weight of zirconium;

iii. 0.15% by weight of magnesium;
iv. 0.15% by weight of titanium; and
v. 2.55% by weight of copper The silver based alloy of the present invention exhibits improved hardness, are springier, show substantial resistance to wear and tear, there is minimum loss of silver during polishing, retains the aesthetics of the silver items without causing permanent deformation and maintains the color and lustre of silver compared to conventional silver alloy with copper having at least 90% silver.

Other objects of the present invention and advantages accruing therefrom will be apparent to one skilled in the art in the following description. All percentages referred to is "percent by weight of the total weight of the alloy".

DISCLOSURE OF THE INVENTION

The Applicant surprisingly found that adding alloying elements zirconium, magnesium and titanium in appropriate amounts to silver of at least 90% by weight and balance being copper provides silver alloy that have excellent mechanical properties in terms of improved hardness, with workable springiness, has reduced specific gravity, is resistant to wear and tear suitable for jewellery, coinage, decorative items, utensils, and such like.

While the prior arts are relying on age hardening method that requires heating for improving the mechanical properties such as hardness of silver alloy the present invention, however, provides strengthening/hardening to silver alloy both 'as cast' and when 'cold worked' using suitable alloy in appropriate amount.

The term "Springiness" used in the entire specification means and relates to a measure of how far the alloy/product can be deflected without causing permanent deformation. Thus, a high elastic deflection is necessary because it can produce a more constant force and has a great working range.

Accordingly, the present invention discloses an alloy composition with improved mechanical properties comprising;

i. 0.01 to 1.5% by weight of zirconium;
ii. 0.01 to 1.5% by weight of magnesium,
iii. 0.01 to 1.5% by weight of titanium; for at least 90% by weight of silver and wherein the balance of said alloy includes copper.

In an embodiment, the present invention discloses the silver alloy compos with improved mechanical properties comprising;

i. 90.0% to 99.5% by weight of silver;
ii. 0.01 to 1.5% by weight of zirconium;
iii. 0.01 to 1.5% by weight of magnesium;
iv 0.01 to 1.5% by weight of titanium; and
v. 0.1 to 9.97% by weight of copper.

In another preferred embodiment, the present invention discloses sterling silver alloy composition with improved mechanical properties comprising;

vi. 92.5% by weight of silver;
vii. 0.15% by weight of zirconium;
viii. 0.15% by weight of magnesium;
ix. 0.15% by weight of titanium; and
x. 7.05% by weight of copper.

In another preferred embodiment, the present invention discloses silver alloy composition with improved mechanical properties comprising;

vi. 97% by weight of silver;
vii. 0.15% by weight of zirconium;
viii. 0.15% by weight of magnesium;
ix. 0.15% by weight of titanium; and
x. 2.55% by weight of copper The alloy of the present invention containing zirconium, magnesium and titanium as alloying metals for at least 90% by weight of silver has substantially high "as cast" hardness as well as when "cold worked" in comparison to the conventional silver alloy.

Accordingly, the silver alloy of the present invention has substantially high "as cast" Vickers hardness in the range of 130-150HV. Further, cold work hardening (60%) of the high "as cast" silver alloy results in the alloy having Vickers hardness in the range of 150-180HV.

The silver alloy of the present invention has mean specific gravity in the range of 9.95 to 10.15 g/cc.

The alloy of the present invention exhibits very similar to regular sterling color and lustre. The alloy of the present invention with at least 90% by weight of silver are springier thereby retaining the aesthetics of the jewellery and silver items without causing permanent deformation.

The alloy of the present invention with at least 90% by weight of silver show substantial resistance to wear and tear, there is minimum loss of silver during polishing, and maintains the color and lustre of silver.

In an embodiment, the sterling silver alloy of the present invention, has improved high "as cast" hardness and "cold work hardness" along with springiness even if copper is present which properties are not met in conventional sterling silver alloy.

Similarly, the appropriate proportion of the alloying metals selected from zirconium, magnesium, titanium when alloyed with 97% by weight of silver along with conventional metal such as copper provides silver alloy with improved high "as cast" hardness and "cold worked hardness" along with springiness useful for manufacturing silverwares, coinage and decorative items.

In an embodiment, the present invention provides the use of alloying metals selected from the group consisting of zirconium, magnesium and titanium in appropriate proportions which are compatible with at least 90% by weight of silver and other conventional alloying metals and imparts solid solution strengthening/hardening of alloy. The alloy of the present invention have high hardness both "as cast" and "cold worked", springiness, has reduced specific gravity, reduced wear and tear suitable for making jewellery, coinage, silverwares and decorative items.

The invention is described in greater detail with reference to the examples which are intended to be purely illustrative and not limited to the present invention and are provided in order to be favouring their being understood by a person skilled in art.

EXAMPLE 1

The alloy containing at least 90% by weight of silver and alloying metals zirconium, titanium, magnesium and copper in varying proportion as shown in example 2 and 3 below were prepared by solid-solution method. For comparative purpose, the conventional silver alloy was prepared by similar method.

Accordingly, to the fine silver was added the alloying metals titanium, zirconium, magnesium and copper, mixed and melted in vacuum furnace to form the melt. The obtained melt was mold casted and cooled. The "as cast" alloy was further cold worked to 60% at room temperature to obtain the alloy,

EXAMPLE 2

Composition of the Present Alloy:
Silver (Ag)—92.5% by weight
Titanium (Ti)—0.15% by weight
Zirconium (Zr)—0.15% by weight
Magnesium (Mg)—0.15% by weight
Copper (Cu)—7.05% by weight
Conventional Sterling Silver:
Silver (Ag)—92.5% by weight
Copper (Cu)—7.5% by weight

| Properties | Present Sterling Silver Alloy | Conventional Sterling Silver |
|---|---|---|
| Hardness "as cast" | 140-145-146 | 114-121-123 |
| 60% cold work Hardening | 166-171-173 | 133-138-140 |
| Wear Resistance Size: 10*10*0.8 mm | Wt. before Test-0.800 gm Wt. after Test-0.795 gm | Wt. before Test-0.830 gm Wt. after Test-0.815 gm |
| Percentage Loss: Keeping all pieces in polishing media (1 day) | 0.625% of the total weight | 1.8% of the total weight |
| Specific Gravity | 9.98 g/cc (mean) | 10.36 g/cc |
| Reduction In Gravity % | 3.668 | |
| Springiness Test (with cantilever configuration) W = 10.2, T = 1.01, L = 85 mm, Load vs. Deflection (max) | 325 gm*11.7 mm | 250 gm*10.5 mm |

Specific Gravity: The results depict that the mean specific gravity of the present sterling silver alloy is significantly reduced. While the specific gravity of the conventional sterling silver alloy is 10.36 g/cc the mean specific gravity of the present sterling silver alloy is 9.98 g/cc which is 3.668% lesser than the conventional sterling silver alloy.

Hardness: The high "as cast" hardness as well as the cold worked (60%) hardness of the present sterling silver alloy is significantly higher than the conventional sterling silver alloy. The improved hardness of the present sterling silver alloy makes the present alloy a promising commercial alloy as the conventional sterling silver alloy is soft for jewellery applications.

Springiness: Higher deflection is observed even for higher grammage or sterling silver alloy of the present invention indicating enhanced springiness of the silver alloy useful in manufacture of jewellery articles.

EXAMPLE 3

Composition of the present Alloy:
Silver (Ag)—97.0% by weight
Titanium (Ti)—0.15% by weight
Zirconium (Zr)—0.15% by weight
Magnesium (Mg)—0.15% by weight
Copper (Cu)—2.55% by weight
Conventional Silverware:
Silver (Ag)—970% h weight
Copper (Cu)—3.0% by weight

| Properties | Present Silver Alloy | Conventional Silverware |
|---|---|---|
| Hardness "as cast" | 133-135-145 | 90-92-102 |
| 60% cold work Hardening | 150-150-152 | 113-115-117 |

-continued

| Properties | Present Silver Alloy | Conventional Silverware |
|---|---|---|
| Wear Resistance Size: 10*10*0.8 mm | Wt. before Test-0.790 gm Wt. after Test-0.780 gm | Wt. before Test-0.800 gm Wt. after Test-0.783 gm |
| Percentage Loss: Keeping all pieces in polishing media (1 day) | 1.26% of the total weight | 2.12% of the total weight |
| Specific Gravity | 10.12 g/cc (mean) | 10.44 g/cc |
| Reduction In Gravity % | 3.065 | |
| Springiness Test (with cantilever configuration) W = 10.2, T = 1.01, L = 85 mm, Load vs. Deflection (max) | 280 gm*10.1 mm | 250 gm* 9.6 mm |

Specific Gravity: The results depict that the mean specific gravity of the present silver alloy comprising 97% by weight of silver is significantly reduced. While the specific gravity of the conventional silver alloy (97% by weight of silver) is 10.44 g/cc the mean specific gravity of the present silver alloy (97% by weight of silver) is 10.12 g/cc which is 3.065% lesser than the conventional silver Hardness: The high "as cast" hardness as well as the cold work (60%) hardness of the present silver alloy (97% by weight of silver) is significantly higher than the conventional silver alloy (97% by weight of silver). The improved hardness of the present silver alloy makes the present alloy a promising commercial alloy.

Springiness: Higher deflection is observed even for higher grammage of silver alloy of the present invention.

I claim:

1. An alloy composition comprising;
i. at least 92.5% by weight of silver;
ii. 0.01 to 1.5% by weight of zirconium;
iii. 0.01 to 1.5% by weight of magnesium;
iv. 0.01 to 1.5% by weight of titanium;
wherein the balance is copper; and
wherein the alloy composition has an "as cast" Vickers hardness of 130 HV to 150 HV.

2. The alloy composition as claimed in claim 1, comprising 92.5% to 99.5% by weight of silver.

3. The alloy composition as claimed in claim 2, comprising;
i. 92.5% by weight of silver;
ii. 0.15% by weight of zirconium;
iii. 0.15% by weight of magnesium;
iv. 0.15% by weight of titanium; and
v. 7.05% by weight of copper.

4. The alloy composition as claimed in claim 2, comprising;
i. 97% by weight of silver;
ii. 0.15% by weight of zirconium;
iii. 0.15% by weight of magnesium;
iv. 0.15% by weight of titanium; and
v. 2.55% by weight of copper.

5. The alloy composition with improved mechanical properties as claimed in claim 2, wherein the alloy composition has increased elastic deflection, as compared to a comparative alloy consisting of 92.5% to 99.5% by weight of silver, with the balance of the comparative alloy being copper.

6. The alloy composition with improved mechanical properties as claimed in claim 3, wherein the alloy composition has increased elastic deflection, as compared to a comparative alloy consisting of 92.5% by weight of silver and 7.5% by weight of copper.

7. The alloy composition with improved mechanical properties as claimed in claim 4, wherein the alloy composition has increased elastic deflection, as compared to a comparative alloy consisting of 97% by weight of silver and 3% by weight of copper.

8. An alloy composition comprising;

i. at least 92.5% by weight of silver;

ii. 0.01 to 1.5% by weight of zirconium;

iii. 0.01 to 1.5% by weight of magnesium;

iv. 0.01 to 1.5% by weight of titanium;

wherein the balance is copper; and wherein cold work hardening (60%) of the alloy composition produces a Vickers hardness of 150 HV to 180 HV.

9. An alloy composition comprising;

i. at least 92.5% by weight of silver;

ii. 0.01 to 1.5% by weight of zirconium;

iii. 0.01 to 1.5% by weight of magnesium;

iv. 0.01 to 1.5% by weight of titanium;

wherein the balance is copper; and wherein the alloy composition has a specific gravity of 9.95 g/cc to 10.15 g/cc.

* * * * *